US012370402B2

(12) United States Patent
Anhorn

(10) Patent No.: US 12,370,402 B2
(45) Date of Patent: Jul. 29, 2025

(54) ROW BAR MOUNTING ASSEMBLY

(71) Applicant: Blue Ridge Enterprises, LLC, Jasper, GA (US)

(72) Inventor: Brent Anhorn, Woodstock, GA (US)

(73) Assignee: Blue Ridge Enterprises, LLC, Jasper, GA (US)

( * ) Notice: Subject to any disclaimer, the term of this patent is extended or adjusted under 35 U.S.C. 154(b) by 170 days.

(21) Appl. No.: 18/220,046

(22) Filed: Jul. 10, 2023

(65) Prior Publication Data

US 2025/0018243 A1 Jan. 16, 2025

(51) Int. Cl.
*A63B 22/00* (2006.01)

(52) U.S. Cl.
CPC .. *A63B 22/0076* (2013.01); *A63B 2022/0082* (2013.01)

(58) Field of Classification Search
CPC . A63B 22/0076; A63B 21/06; A63B 21/0608; A63B 21/0615; A63B 21/0617
See application file for complete search history.

(56) References Cited

U.S. PATENT DOCUMENTS

| | | | | |
|---|---|---|---|---|
| 2,189,975 A | | 2/1940 | Carlson | |
| 2,338,555 A | | 1/1944 | Vander Meer | |
| 3,065,003 A | | 11/1962 | Whitehouse | |
| 4,149,282 A | | 4/1979 | Browning | |
| 4,218,056 A | | 8/1980 | Whitling | |
| 4,717,145 A | | 1/1988 | Chininis | |
| 5,306,217 A | * | 4/1994 | Bracone | A63B 21/157 4/496 |

(Continued)

FOREIGN PATENT DOCUMENTS

| | | |
|---|---|---|
| WO | 98/41289 A1 | 9/1998 |
| WO | 00/74626 A1 | 12/2000 |

(Continued)

OTHER PUBLICATIONS

Marine City, Marine City 316 Grade Stainless Steel Heavy Duty Clamp on Shaft Rowlock Oarlock Side Mount Fine Finish, Published: Jun. 5, 2018, <URL: https://www.amazon.com/MARINE-CITY-Stainless-Rowlock-Oarlock/dp/B07F9QMVMM> (Year: 2018).*

(Continued)

*Primary Examiner* — Zachary T Moore
(74) *Attorney, Agent, or Firm* — Kaplan Breyer Schwarz, LLP

(57) ABSTRACT

A row bar pivot assembly includes a mounting plate for fixedly attaching to a side wall of a swim spa or the like and a row bar pivot assembly detachably connected to the mounting plate. The row bar pivot assembly allows a row bar to be removably mounted to the side wall of the spa, swim spa, the hot tub, or the pool. Further, a rowing exercise system includes a swim spa or the like, and a pair of row bar mounting assemblies, one for each of opposing side wall areas of the swim spa. Each of the row bar mounting assemblies includes a mounting plate for fixedly attaching to the side wall area of the swim spa, a row bar pivot assembly detachably connected to the mounting plate, and a row bar attached to the row bar pivot assembly. The row bar pivot assemblies removably mount the row bars to the side wall areas of the swim spa.

22 Claims, 10 Drawing Sheets

(56) References Cited

U.S. PATENT DOCUMENTS

| | | | | |
|---|---|---|---|---|
| 5,385,525 | A | 1/1995 | Davis | |
| 5,554,091 | A | 9/1996 | Patey | |
| 5,665,039 | A | 9/1997 | Wasserman et al. | |
| 7,553,261 | B2 | 6/2009 | Carbone | |
| 7,597,652 | B2 * | 10/2009 | Walker | A63B 21/0084 4/576.1 |
| 7,628,739 | B2 | 12/2009 | Gearon | |
| 7,918,771 | B2 * | 4/2011 | Rogers | A63B 21/4035 482/100 |
| 8,157,713 | B1 | 4/2012 | Siskowic et al. | |
| 9,878,196 | B2 | 1/2018 | Lin | |
| 10,220,248 | B1 * | 3/2019 | Bellerive | A63B 69/08 |
| 10,441,834 | B2 | 10/2019 | Liu et al. | |
| 2003/0100411 | A1 * | 5/2003 | Walker | A63B 21/0084 482/55 |
| 2006/0264128 | A1 | 11/2006 | Osten | |
| 2009/0054210 | A1 | 2/2009 | Tomatis | |
| 2021/0236870 | A1 * | 8/2021 | Bergengren | A63B 21/0056 |
| 2023/0001257 | A1 * | 1/2023 | Gunwall | A63B 21/0435 |
| 2023/0347207 | A1 * | 11/2023 | Joseph | A63B 21/4019 |

FOREIGN PATENT DOCUMENTS

| | | | |
|---|---|---|---|
| WO | 2004/067106 | A1 | 8/2004 |
| WO | 2011/021144 | A1 | 2/2011 |

OTHER PUBLICATIONS

"Endless Pools Fitness Systems 2023 Collection", Endless Pools, endlesspools.com, https://www.endlesspools.com/product_documentation/2022-07-29-07-45-25/357643/ep_2023_collection_handout_rev_f.pdf, Jan. 26, 2023.

"Master Spa—X510290—Rowing Arm Base", Master Spa Parts, masterspapartsonline.com, Jan. 15, 2022, https://webcache.googleusercontent.com/search?q=cache:qdZwLyZPfg4J:https://www.masterspapartsonline.com/products/master-spa-x510290-rowing-arm-base.html&cd=1&hl=en&ct=clnk&gl=us, Jan. 26, 2023.

"Row Exercise Kit", Arctic Spas, arcticspastore.com, Jan. 23, 2022, https://webcache.googleusercontent.com/search?q=cache:WoFxiHpUVDgJ:https://www.arcticspastore.com/arctic-spa-accessories/row-exercise-kit-arctic-spas/&cd=2&hl=en&ct=clnk&gl=us, Jan. 26, 2023.

"Improvement in Oars", U.S. Pat. No. 88,013 issued Mar. 23, 1869, Inventor: Henry W. Connor, 2 pp.

* cited by examiner

ROW BAR MOUNTING ASSEMBLY

FIELD

The present disclosure relates to exercise equipment and more particularly to a row bar mounting assembly that allows a pair of row bars to be removably mounted on opposing sides of a spa, swim spa, hot tub, or pool to create a rowing machine inside the spa, swim spa, hot tub, or pool.

BACKGROUND

People today are concerned about their physical fitness and health. As a result, many more people utilize health clubs and perform exercise routines at home in order to lose weight and maintain a healthy lifestyle. Some people perform exercise routines such as rowing in spas and pools because such exercise routines are low impact and, therefore, have less muscular-skeletal side effects.

Therefore, rowing devices have been developed for use in spas, hot tubs, and/or pools. Such devices and apparatus expand the scope of use of spas, hot tubs, and pools, and substantially eliminate the need for a separate rowing machine, thus reducing cost and space requirements. Most existing rowing devices are permanently installed in the spa, swim spa, hot tub, or pool and require tools to remove the row-bars, when the rowing device is not being used.

Therefore, a row bar mounting assembly is needed, which allows the row bars to be easily installed on and removed from opposing sides of a spa, swim spa, hot tub, or pool, without the use of tools.

SUMMARY

Disclosed herein a row bar pivot assembly comprising, in various embodiments, a mounting plate for fixedly attaching to a side wall of a spa, swim spa, a hot tub, or a pool and a row bar pivot assembly detachably connected to the mounting plate, the row bar pivot assembly for removably mounting a row bar to the side wall of the spa, swim spa, the hot tub, or the pool.

In some embodiments of the row bar mounting assembly, the row bar pivot assembly includes an inner pivot yoke, an outer pivot yoke, and a pivot link pivotally connecting the outer pivot yoke to the inner pivot yoke.

In some embodiments of the row bar mounting assembly, the pivot link and inner pivot yoke are configured to allow side to side and/or up and down pivoting of the pivot link relative to the inner pivot yoke.

In some embodiments of the row bar mounting assembly, the pivot link and the outer pivot yoke are configured to allow side to side and/or up and down pivoting of the outer pivot relative to the pivot link.

In some embodiments of the row bar mounting assembly, the pivot link and inner pivot yoke are configured to allow side to side pivoting of the pivot link relative to the inner pivot yoke and wherein the pivot link and inner pivot yoke are configured to allow up and down pivoting of the pivot link relative to the inner pivot yoke.

In some embodiments of the row bar mounting assembly, the pivot link and inner pivot yoke are configured to allow up and down pivoting of the pivot link relative to the inner pivot yoke and wherein the pivot link and inner pivot yoke are configured to allow side to side pivoting of the pivot link relative to the inner pivot yoke.

In some embodiments of the row bar mounting assembly, the row bar pivot assembly is configured to allow the row bar, when attached thereto, to be freely rotated.

In some embodiments of the row bar mounting assembly, the outer pivot yoke includes a coupling member for attaching the row bar to the row bar pivot assembly.

In some embodiments of the row bar mounting assembly, the mounting plate includes a channel and the inner pivot yoke of the row bar pivot assembly includes a tongue member that is slidably received in the channel of the mounting plate, to detachably connect the row bar pivot assembly to the mounting plate.

In some embodiments of the row bar mounting assembly, the channel of the mounting plate includes a first detent member and the inner pivot yoke of the row bar pivot assembly includes a resiliently bendable tab with a second detent member, wherein during the connection of the row bar pivot assembly to the mounting plate, the tongue member slides into the channel until the second detent member engages the first detent member, thereby locking the row bar pivot assembly to the mounting plate and wherein during the detachment of the row bar pivot assembly from the mounting plate, the second detent member disengages from the first detent member when the tab is bent, thereby unlocking the row bar pivot assembly to the mounting plate and allowing the tongue member of the row bar pivot assembly to slide out of the channel of the mounting plate.

Further disclosed herein is a rowing exercise system comprising, in various embodiments, a receptacle for containing water, which is sized to allow a user to stand, squat, and/or sit in the receptacle, a pair of row bar pivot assemblies, one for each of opposing side wall areas of the receptacle. Each of the row bar pivot assemblies comprises, in various embodiments, a mounting plate for fixedly attaching to the side wall area of the receptacle, a row bar pivot assembly detachably connected to the mounting plate, and a row bar attached to the row bar pivot assembly. The row bar pivot assemblies removably mount the row bars to the side wall areas of the receptacle.

In some embodiments of the rowing exercise system, each of the row bar pivot assemblies includes an inner pivot yoke, an outer pivot yoke, and a pivot link pivotally connecting the outer pivot yoke to the inner pivot yoke.

In some embodiments of the rowing exercise system, the pivot link and inner pivot yoke are configured to allow side to side and/or up and down pivoting of the pivot link relative to the inner pivot yoke.

In some embodiments of the rowing exercise system, the pivot link and the outer pivot yoke are configured to allow side to side and/or up and down pivoting of the outer pivot relative to the pivot link.

In some embodiments of the rowing exercise system, the pivot link and inner pivot yoke are configured to allow side to side pivoting of the pivot link relative to the inner pivot yoke and wherein the pivot link and inner pivot yoke are configured to allow up and down pivoting of the pivot link relative to the inner pivot yoke.

In some embodiments of the rowing exercise system, the pivot link and inner pivot yoke are configured to allow up and down pivoting of the pivot link relative to the inner pivot yoke and wherein the pivot link and inner pivot yoke are configured to allow side to side pivoting of the pivot link relative to the inner pivot yoke.

In some embodiments of the rowing exercise system, each of the row bar pivot assemblies is configured to allow their respective row bar to be freely rotated.

In some embodiments of the rowing exercise system, the outer pivot yoke includes a coupling member that attached the row bar to the row bar pivot assembly.

In some embodiments of the rowing exercise system, the mounting plate includes a channel and the inner pivot yoke of the row bar pivot assembly includes a tongue member that is slidably received in the channel of the mounting plate, to detachably connect the row bar pivot assembly to the mounting plate.

In some embodiments of the rowing exercise system, the channel of the mounting plate includes a first detent member and the inner pivot yoke of the row bar pivot assembly includes a resiliently bendable tab with a second detent member, wherein during the connection of the row bar pivot assembly to the mounting plate, the tongue member slides into the channel until the second detent member engages the first detent member, thereby locking the row bar pivot assembly to the mounting plate and wherein during the detachment of the row bar pivot assembly from the mounting plate, the second detent member disengages from the first detent member when the tab is bent, thereby unlocking the row bar pivot assembly to the mounting plate and allowing the tongue member of the row bar pivot assembly to slide out of the channel of the mounting plate.

In some embodiments of the rowing exercise system, the receptacle comprises a spa, swim spa, a hot tub, or a pool.

BRIEF DESCRIPTION OF THE DRAWING

The disclosure is best understood from the following detailed description when read in conjunction with the accompanying drawing. It is emphasized that, according to common practice, the various features of the drawing are not necessarily to scale. On the contrary, the dimensions of the various features may be arbitrarily expanded or reduced for clarity. Like numerals denote like features throughout the specification and the drawing.

DETAILED DESCRIPTION

It should be understood that the phraseology and terminology used below for the purpose of description and should not be regarded as limiting. The use herein of the terms "comprising," "including," "having," "containing," and variations thereof are meant to encompass the structures and features recited thereafter and equivalents thereof as well as additional structures and features. Unless specified or limited otherwise, the terms "attached," "mounted," "affixed," "connected," "supported," "coupled," and variations thereof are used broadly and encompass both direct and indirect forms of the same.

Figure 1:
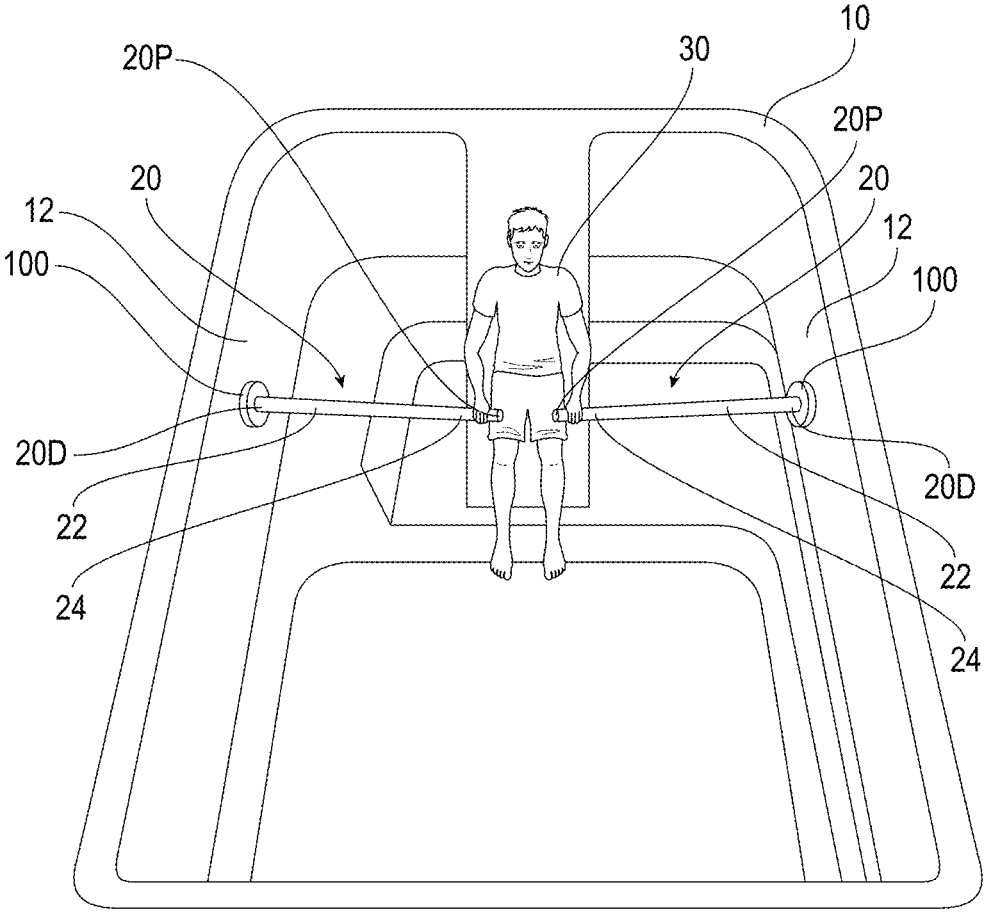
FIG. 1 is an angled top view of an exemplary embodiment of a spa, which illustrates a pair of row bar mounting assemblies, which are configured to allow a pair of row bars to be mounted on opposing side walls of a spa to create a rowing machine inside the spa.

FIG. 1 illustrates a pair of row bar mounting assemblies 100, according to the present disclosure, which are configured to allow a pair of row bars 20 to be mounted on opposing side walls 12 of a spa 10 without tools, to create a rowing machine inside the spa 10, and removed from the opposing side walls 12 of the spa 10 without tools, when the rowing machine is not needed inside the spa 10. The user 30 grips the row bars 20 from a seated, squatting, or standing position in a rowing motion. The row bars 20 are typically formed from one or more tubes 22. The proximal end 20P of each row bar 20 can include a hand grip 24 and the distal end 20D of each row bar 20 connects to the corresponding row bar mounting assembly 100. The mounting assemblies 100 are also intended for use in swim spas, hot tubs and pools.

Figure 2A:
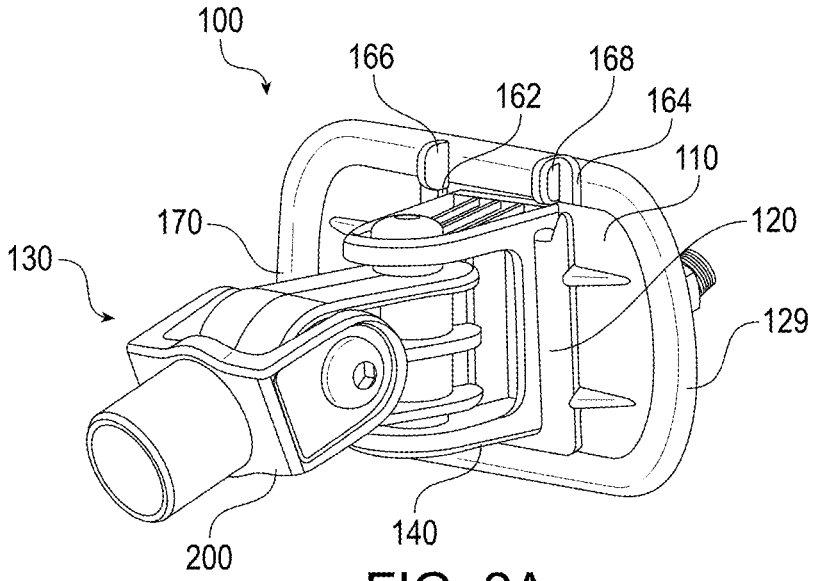
FIG. 2A is perspective front view of an exemplary embodiment of a row bar mounting assembly illustrating a row bar pivot assembly of the row bar mounting assembly connected to a mounting plate of the row bar mounting assembly.
Figure 2B:
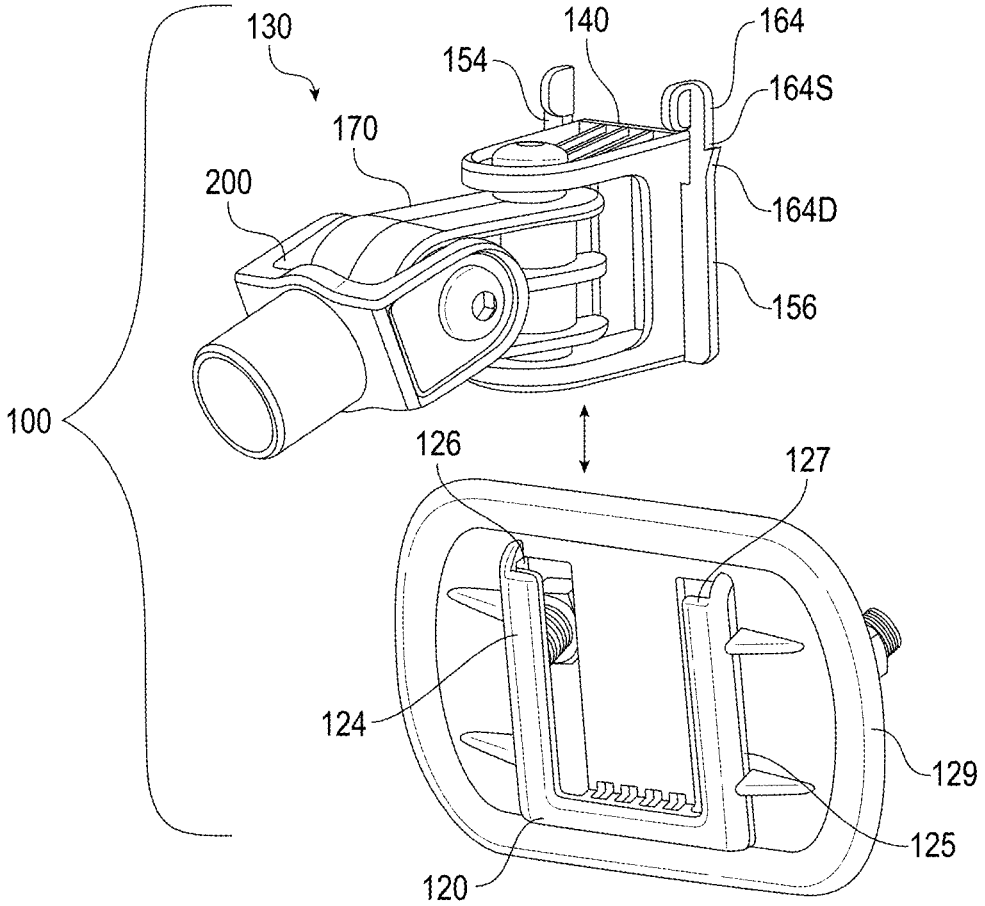
FIG. 2B is perspective front view of the row bar mounting assembly of FIG. 2A with the row bar pivot assembly of the row bar mounting assembly detached from the mounting plate of the row bar mounting assembly.

FIGS. 2A and 2B collectively illustrate an exemplary embodiment of the row bar mounting assembly 100 of the present disclosure. The row bar mounting assembly 100 comprises a row bar pivot assembly mounting plate 110 (mounting plate) and a mounting plate trim ring 129, which are configured to be permanently mounted on the side wall 12 of the spa 10 (FIG. 1), and a row bar pivot assembly 130 that is configured to be detachably connected to the mounting plate 110. The row bar pivot assembly 130 (pivot assembly) includes an inner pivot yoke 140, an outer pivot yoke 200, and a pivot link 170 pivotally connecting the outer pivot yoke 200 to the inner pivot yoke 140. A row bar (not shown) is permanently or removably connected to the outer pivot yoke 200 of the pivot assembly 130. The row bar pivot assembly 130 allows the row bar row to be freely rotated by the user when the user rows the row bar in a rowing motion.

Figure 3A:
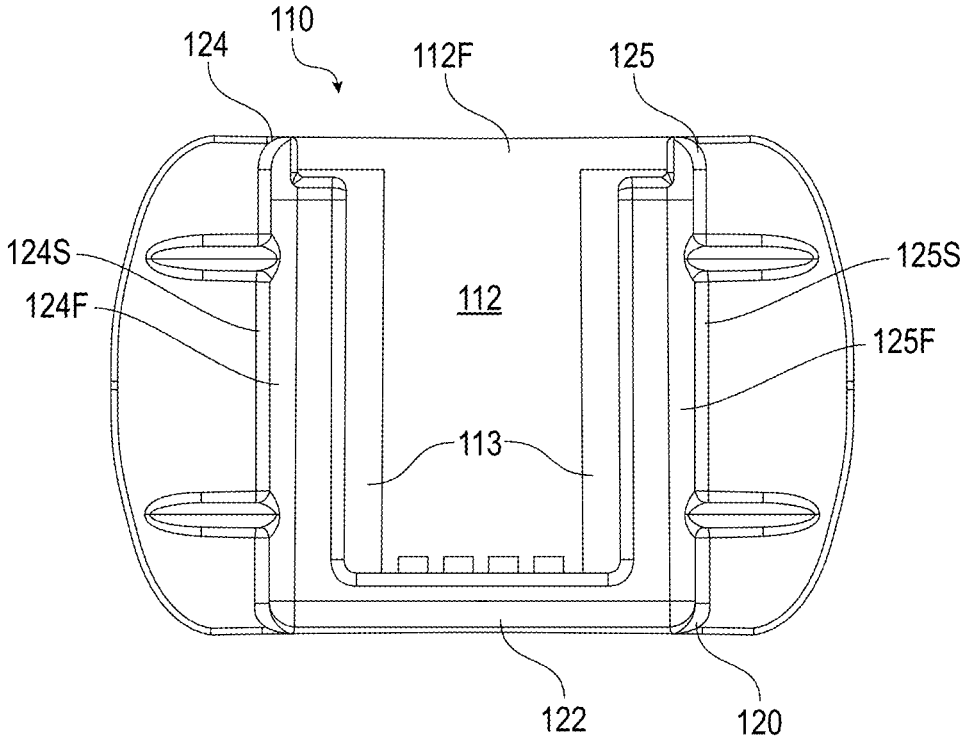
FIG. 3A is a front view of an exemplary embodiment of the mounting plate.
Figure 3B:
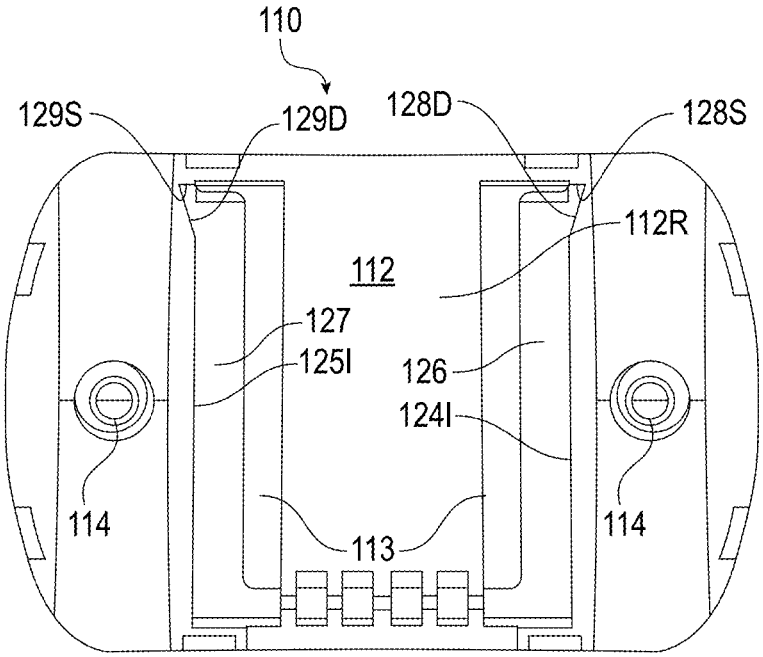
FIG. 3B is a rear view of the mounting plate of FIG. 3A.
Figure 3C:
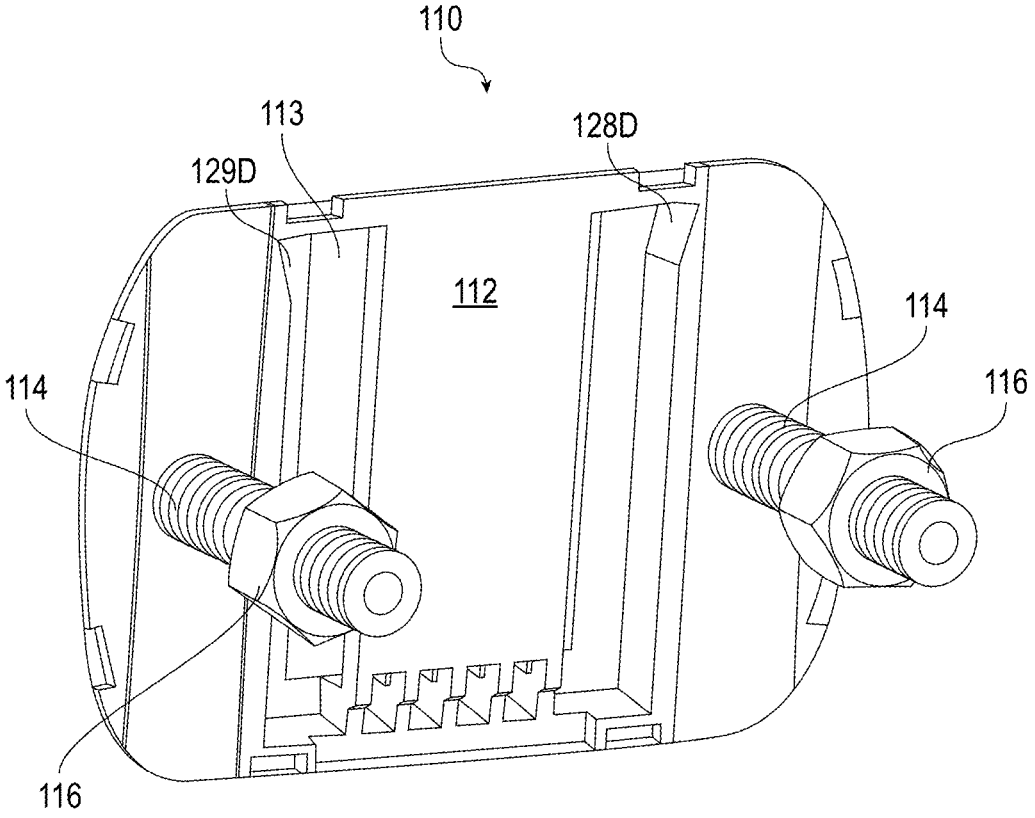
FIG. 3C is a perspective rear view of the mounting plate of FIG. 3A.
Figure 7:
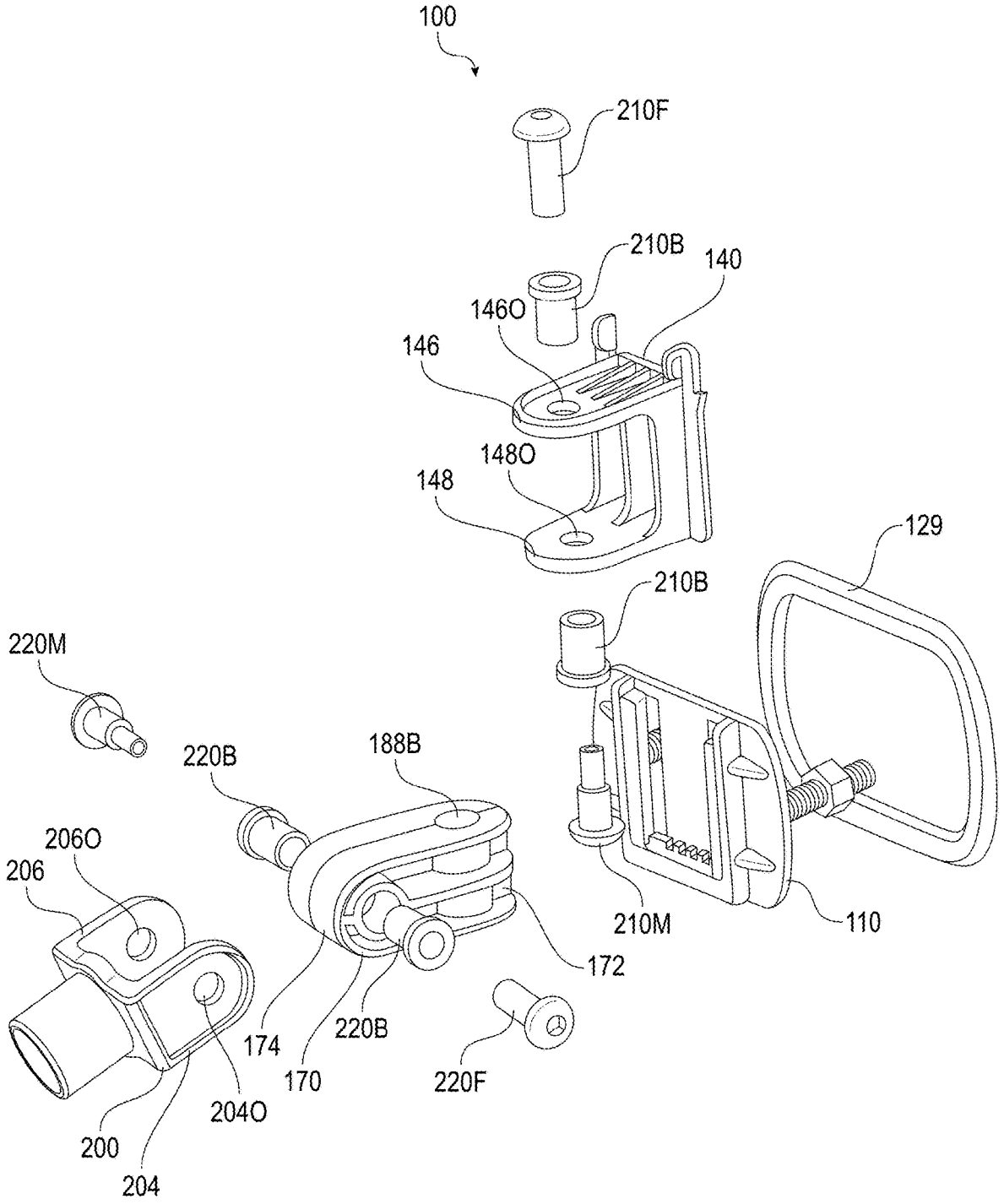
FIG. 7 is an exploded perspective front view of the row bar mounting assembly of FIG. 2A.

Referring collectively to FIGS. 3A-3C, the mounting plate 110 in an exemplary embodiment, can be unitarily formed from any suitable polymeric material, such as injection grade Acrylonitrile Butadiene Styrene (ABS), and includes a base wall 112, a pair of spaced apart threaded studs 114 extending from a rear surface 112R of the base wall 112 and a raised U-shaped anchor member 120 formed on a front surface 112F of the base wall 112. The mounting plate 110 is inserted within the trim ring 129 (which can be formed from any suitable metal material, such as ASTM 1088 steel) prior to attaching the mounting plate 110 to the side wall 12 of the spa 10 (FIG. 7). The threaded studs 114 of the mounting plate 110 are inserted through mounting holes (not shown) formed in the side wall of the spa to attach the mounting plate 110 to the side wall of the spa. Threaded nuts 116 screw-threaded to the studs 114 securely retain the mounting plate 110 on the side wall of the spa. A suitable sealant, such as adhesive marine sealant, is used to seal around the mounting holes formed in the side wall 12 of the spa after installation. Any water that collects behind the mounting plate 110 is drained through slot/openings 113 formed through the mounting plate 110. The raised U-shaped anchor member 120 includes a cross member 122 that connects first and second arm members 124, 125 at their bottom ends. Each arm member 124, 125 is formed by a forward extending side wall 124S, 125S and an inward extending front wall 124F, 125F. The side wall 124S, 125S and front wall 124F, 125F of each arm member 124, 125 defines a L-shaped channel 126, 127 for slidably receiving a corresponding tongue member 154, 156 of the inner pivot yoke 140 of the pivot assembly 130 (FIGS. 4A and 4B). A recessed wedge shape first detent member 128D, 129D having a downwardly facing catch surface 128S, 129S extends inwardly from an inner surface 124I, 125I of each arm member side wall 124S, 125S at or adjacent a top end thereof.

Figure 4C:
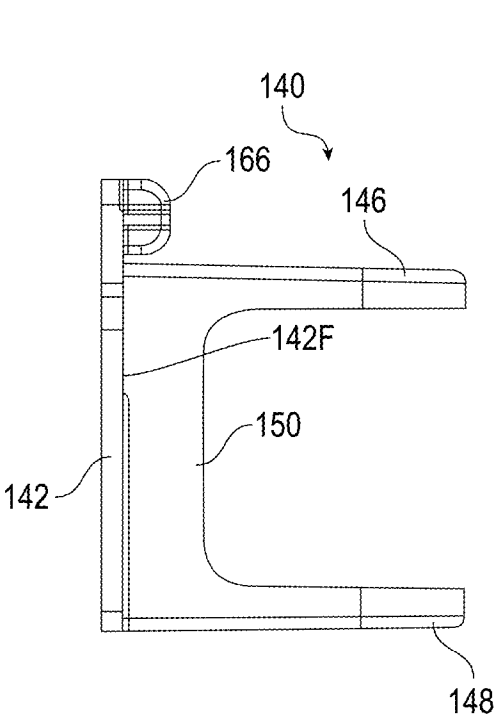
FIG. 4C is a side view of the inner pivot yoke of FIG. 4A.
Figure 4B:
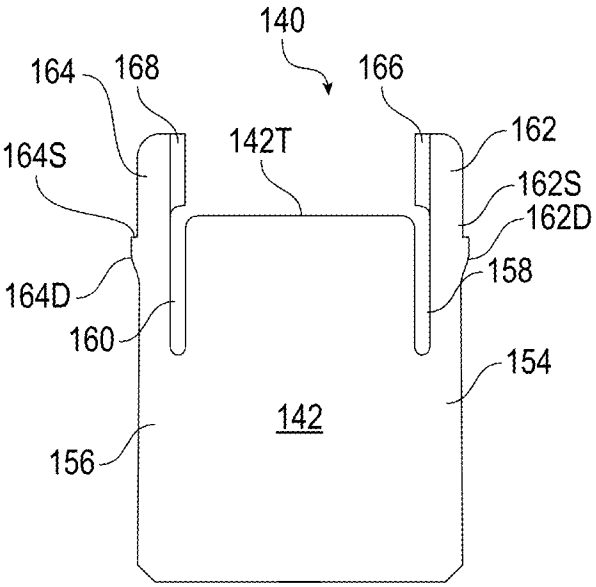
FIG. 4B is a rear view of the inner pivot yoke of FIG. 4A.
Figure 4A:
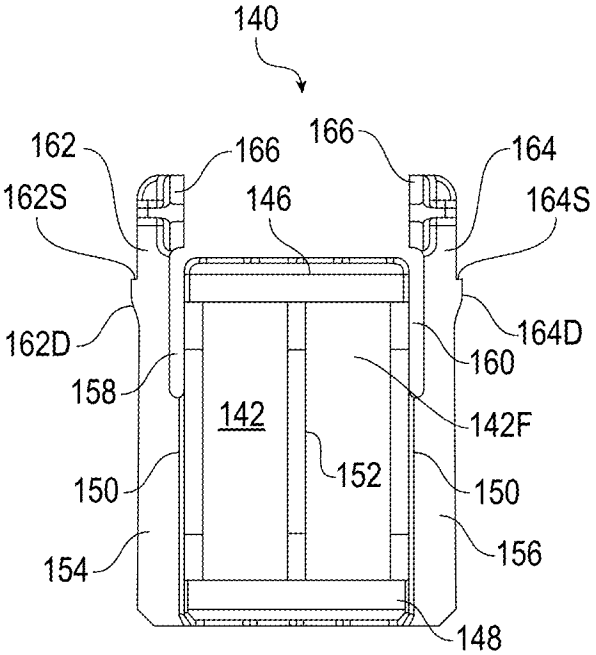
FIG. 4A is a front view of an exemplary embodiment of an inner pivot yoke of the row bar pivot assembly.

Referring to FIGS. 4A-4C, the inner pivot yoke 140 of the pivot assembly 130, in an exemplary embodiment, can be unitarily formed from any suitable polymeric material, such as injection grade ABS, and includes a base wall 142 and upper and lower yoke arms 146, 148 connected to one another by the base wall 142, first and second side reinforcement members 150 and a center reinforcement member 152. The upper yoke arm 146 extends forward from a front surface 142F of the base wall 142 at a top end thereof and a lower yoke arm 148 extends forward from the front surface 142F of the base wall 142 at a bottom end thereof. The upper and lower yoke arms 146, 148 each includes an opening 146O, 148O (FIG. 7). The openings 146O, 148O of the upper and lower yoke arms 146, 148 are axially aligned with one another. Marginal side portions of the base wall 142 extend slightly past the first and second side reinforcement members 150 and the upper and lower yokes arms 146, 148, thereby defining first and second tongue members 154, 156. First and grooves 158, 160 extend downwardly from a top edge 142T of the base wall 142 adjacent to the upper portion of each tongue member 154, 156, thus forming an inwardly and resiliently bendable tab 162, 164. A raised wedge shape detent member 162D, 164D having an upwardly facing catch surface 162S, 164S extends outwardly from an outer side of each tab 162, 164. A finger-gripping member 166, 168 extends forward from a front surface of each of the resiliently bendable tabs 162, 164, at a top end thereof.

Figure 5A:
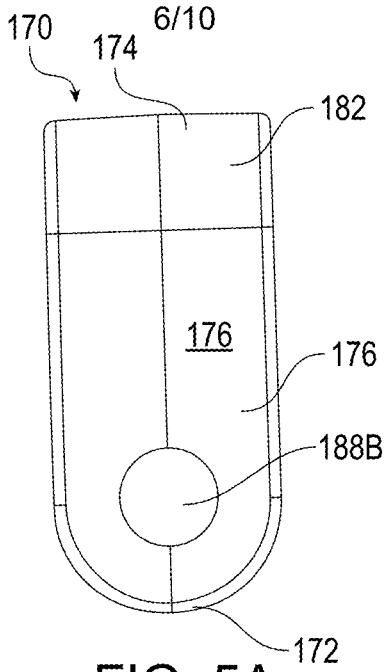
FIG. 5A is a top view of an exemplary embodiment of a pivot link of the row bar pivot assembly.
Figure 5B:
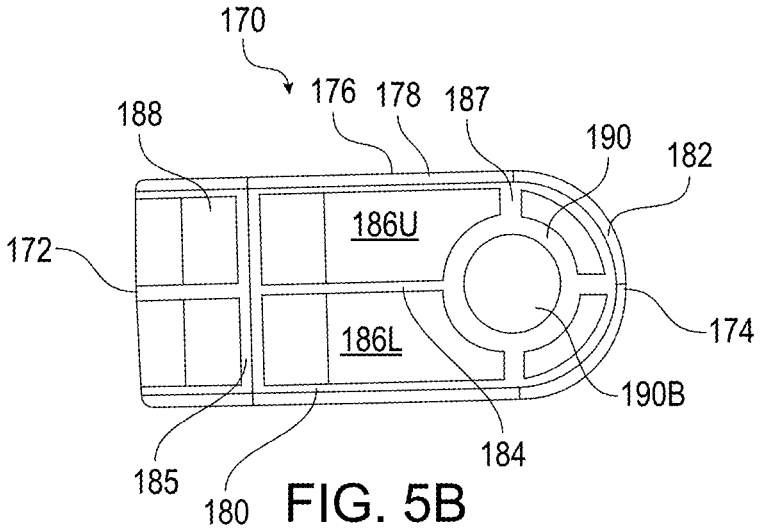
FIG. 5B is a side view of the pivot link of FIG. 5A.
Figure 5C:
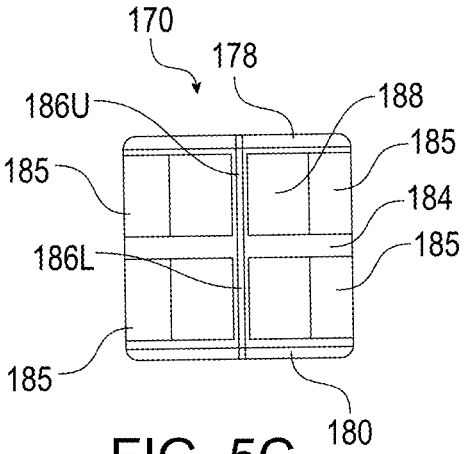
FIG. 5C is an end view of the pivot link of FIG. 5A.
Figure 6B:
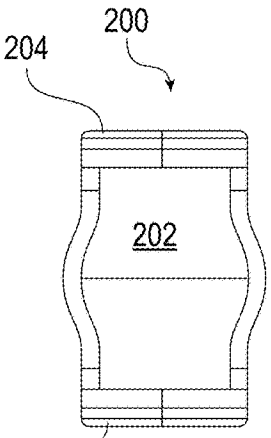
FIG. 6B is a front view of the outer pivot yoke of FIG. 6A.
Figure 6D:
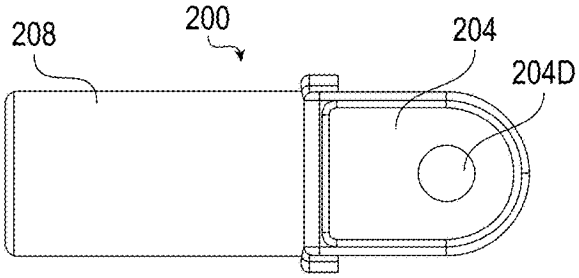
FIGS. 6D and 6E are top and bottom views of the outer pivot yoke of FIG. 6A.
Figure 6A:
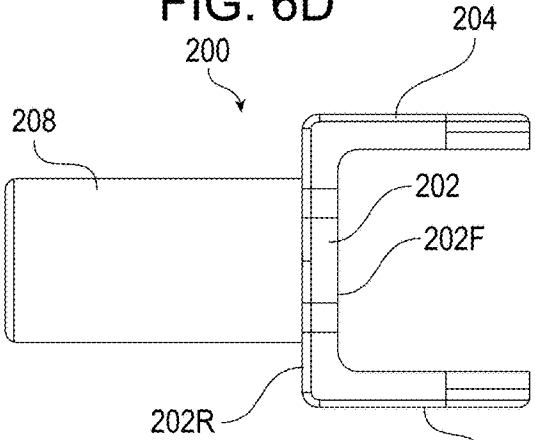
FIG. 6A is a side view of an exemplary embodiment of an outer pivot yoke of the row bar pivot assembly.
Figure 6E:
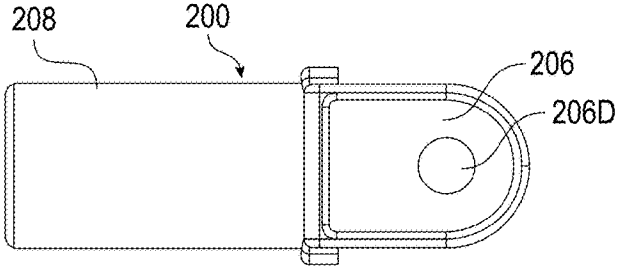
Figure 6C:
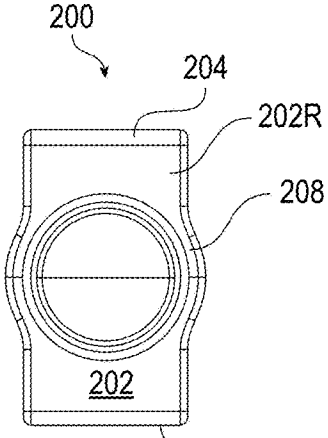
FIG. 6C is a rea view of the outer pivot yoke of FIG. 6A.

Referring to FIGS. 5A-5C, the pivot link 170 of the pivot assembly 130, in an exemplary embodiment, can be unitarily formed from any suitable polymeric material, such as injection grade ABS, and has opposing first and second ends 172, 174. The pivot link 170 is configured with a U-shaped outer wall 176 formed by first and second arm members 178, 180 and a curved member 182 connecting the first and second arm members 178, 180. A horizontal wall 184 is disposed between and parallel with the first and second arm members 178 and 180. A vertical upper reinforcement wall 186U extends through the center or middle of the pivot link 170 between the top of the horizontal wall 184 and the first arm member 178 and a vertical lower reinforcement wall 186L extends through the center or middle of the pivot link 170 between the bottom of the horizontal wall 184 and the second arm 180. A first transversely extending vertical reinforcement wall 185 is provided marginally adjacent to the first end 172 of the pivot link 170 and interconnects with the horizontal wall 184 at a first location thereof, and a second transversely extending vertical reinforcement wall 187 is provided marginally adjacent to the second end 174 of the pivot link 170 and interconnects with the horizontal wall 184 at a second location thereof. A first cylindrical member 188, defining an open-ended bore 188B, is disposed marginally adjacent the first end 172 of the pivot link 170. The first cylindrical member 188 extends vertically between the first and second arm members 178, 180 of the outer wall 176, and through the horizontal wall 184 and vertical reinforcement walls 185, 186U, 186L. Openings 178O and 180O into the open-ends of the bore 188B of the first cylindrical member 188, are provided in the first and second arm members 178 and 180, respectively. A second cylindrical member 190 is disposed marginally adjacent the second end 174 of the pivot link 170 and extends horizontally within the outer wall 176 from one side of the pivot link 170 to the other side of the pivot link 170, and through the horizontal wall 184 and vertical reinforcement walls 186U, 186L 187. The second cylindrical member 190 defines open-ended bore 190B.

Referring to FIGS. 6A-6E, the outer pivot yoke 200 of the pivot assembly 130, in an exemplary embodiment, can be unitarily formed from any suitable polymeric material, such as injection grade ABS, and includes a base wall 202 connecting first and second yoke arms 204, 206. The first yoke arm 204 extends forward from a front surface 202F of the base wall 202 at a first end thereof and the second yoke arm 206 extends forward from the front surface 202F of the base wall 202 at a second end thereof. The first and second yoke arms 204, 206 each includes an opening 204O, 206O. The openings 204O, 206O of the first and second yoke arms 204, 206 are axially aligned with one another. A cylindrical row bar coupling member 208 extends rearward from a rear surface 202R of the base wall 202 for permanently or removably connecting with a distal end of a row bar (e.g., distal end 20D of row bar 20 illustrated in FIG. 1).

Figure 8A:
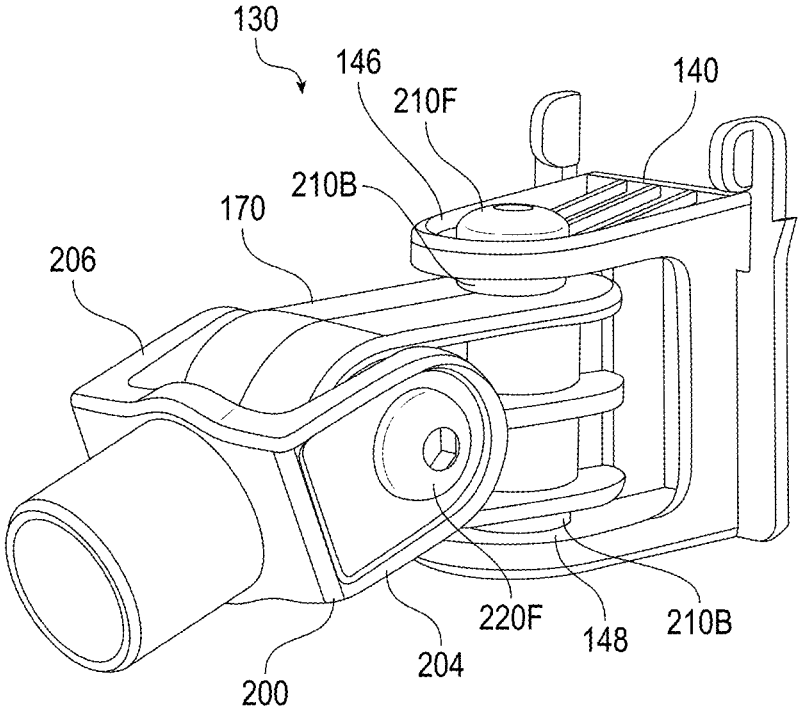
FIGS. 8A and 8B are perspective front and rear views, respectively, of the row bar pivot assembly of FIG. 2A.
Figure 8B:
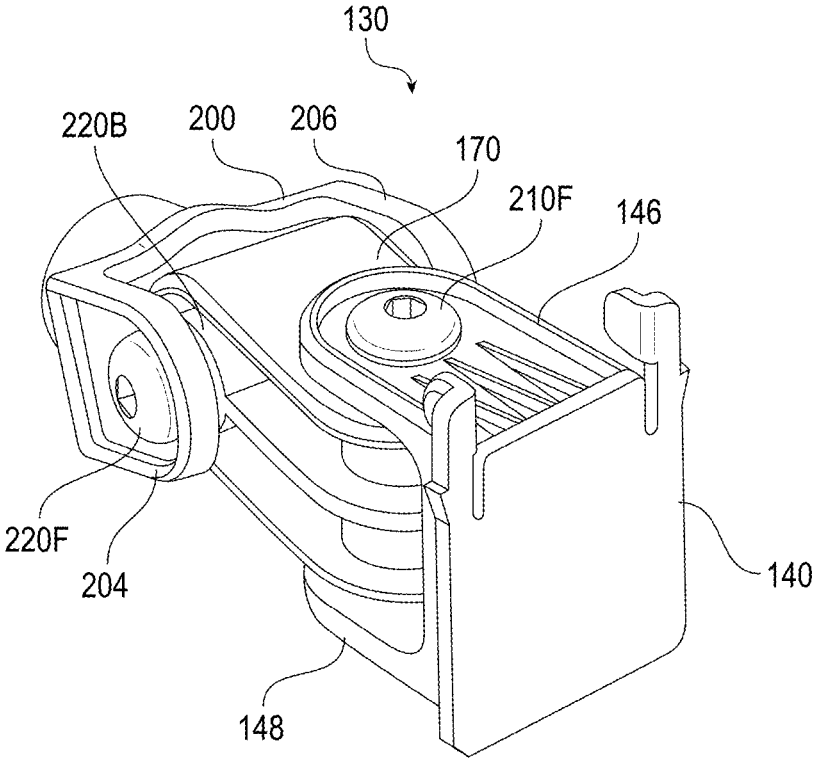

Referring collectively to FIG. 7 and FIGS. 8A and 8B, the first end 172 of the pivot link 170 is pivotally coupled to the inner pivot yoke 140 with a first bushing-fastener arrangement and second end 174 of the pivot link 170 is pivotally coupled to the outer pivot yoke 200 with a second bushing-fastener arrangement. Specifically, the first end 172 of the pivot link 170 is pivotally received between the upper and lower yokes arms 146, 148 of the inner pivot yoke 140 so that the open-ended bore 188B of the first cylindrical member 188 of the pivot link 170, axially aligns with the openings 146O, 148O in the upper and lower yoke arms 146, 148 of the inner pivot yoke 140. A flanged bushing 210B of the first bushing-fastener arrangement extends into each end of the open-ended bore 188B of the first cylindrical member 188 of the pivot link 170 such that the flange of the bushing 210B is disposed between the inner surface of its respective inner pivot yoke arm 146, 148 and the outer surface of the pivot link 170, to allow the pivot link 170 to freely pivot from side-to-side relative to the inner pivot yoke 140. The first end 172 of the pivot link 170 is fastened between the upper and lower yoke arms 146, 148 of the inner pivot yoke 140 with a first shoulder screw 210F (e.g. a female shoulder screw 210F, as shown in FIG. 7) of the first bushing-fastener arrangement, which extends through the opening 146O of the upper yoke arm 146 and one of the flanged bushings 210B, and a second shoulder screw 210M (e.g. a male shoulder screw 210M, as shown in FIG. 7) of the first bushing-fastener arrangement, which extends through the opening 148O of the lower yoke arm 148 and the other one of the flanged bushings 210B, and threadedly engages the first shoulder screw 210F. The second end 174 of the pivot link 170 is pivotally received between the first and second yoke arms 204, 206 of the outer pivot yoke 200 so that the open-ended bore 190B of the second cylindrical member 190 of the pivot link 170, axially aligns with the openings 204O, 206O in the first and second yoke arms 204, 206 of the outer pivot yoke 200. A flanged bushing 220B of the second bushing-fastener arrangement extends into each end of the open-ended bore 190B of the second cylindrical member 190 of the pivot link 170 such that the flange of the bushing 220B is disposed between the inner surface of its respective outer pivot yoke arm 204, 206 and an outer rim surface of the second cylindrical member 190, to allow the outer pivot yoke 200 to freely pivot from up and down relative to the pivot link 170. The second end 172 of the pivot link 170 is fastened between the first and second yoke arms 204, 206 of the outer pivot yoke 200 with a third shoulder screw 220F (e.g. a female shoulder screw 220F, as shown in FIG. 7) of the second bushing-fastener arrangement, which extends through the opening 204O of the first yoke arm 204 and one of the flanged bushings 220B, and a fourth shoulder screw 220M (e.g. a male shoulder screw 220M, as shown in FIG. 2C) of the second bushing-fastener arrangement, which extends through the opening 206O of the second yoke arm 206 and the other one of the flanged bushings 220B and threadedly engages the third shoulder screw 220F.

A row bar affixed to the row bar pivot assembly of the present disclosure can be connected to the spa, swim spa, hot tub, or pool in the following manner. As illustrated in FIG. 2B, the row bar pivot assembly 130 is connected to the mounting plate 110 (mounted on a side wall of a spa, swim spa, hot tub, or pool) by first aligning the bottoms of the tongue members 154, 156 of the inner pivot yoke 140 of the row bar pivot assembly 130 with the top ends of the arm members 124, 125 of the mounting plate anchor member 120, and then pushing the row bar pivot assembly 130 down into the anchor member 120 such that the tongue members 154, 156 of the inner pivot yoke 140 of the row bar pivot assembly 130 enter respective channels 126, 127 defined by anchor arm members 124, 125 of the mounting plate 110. As the row bar pivot assembly 130 is pushed down into the anchor member 120 of the mounting plate 110, the tongue members 154, 156 of the inner pivot yoke 140 of the row bar pivot assembly 130 slide down their respective channels 126, 127 of the anchor member arms 124, 125 of the mounting plate 110. The row bar pivot assembly 130 is pushed down into the anchor member 120 of the mounting plate 110 until the upwardly facing detent surfaces 162S, 164S of the second detent members 162D, 164D of the spring-like tabs 162, 164 of the inner pivot yoke 140 (FIGS. 4A and 4B) engage respective downwardly facing detent surfaces 128S, 129S of the first detent members 128D, 129D formed in the channels 126, 127 of the mounting plate 110 (FIG. 3B) in a snap-like manner, thereby locking the row bar pivot assembly 130 to the mounting plate 110.

A row bar affixed to the row bar pivot assembly of the present disclosure can be detached from the spa, swim spa, hot tub, or pool in the following manner. As illustrated in FIG. 2A, the user grasps the finger-gripping members 166, 168 of the inner pivot yoke 140 of the locking the row bar pivot assembly 130 and uses them to bend the inner pivot yoke spring-like tabs 162, 164 toward one another to disengage the second detent members 162D, 164D of the tabs 162, 164 (FIGS. 4A and 4B) from the first detent members 128D, 129D in the arm member channels 126, 127 of the mounting plate 110 (FIG. 3B), and then pulling the row bar pivot assembly 130 up with respect to the mounting plate 110, thereby causing the tongue members of 154, 156 the inner pivot yoke 140 (FIG. 2B) of the row bar pivot assembly 130 to slide up and out of the arm member channels 126, 127 of the mounting plate 110 (FIG. 2B), thus, disengaging the row bar pivot assembly 130 from the mounting plate 110.

Figure 9A:
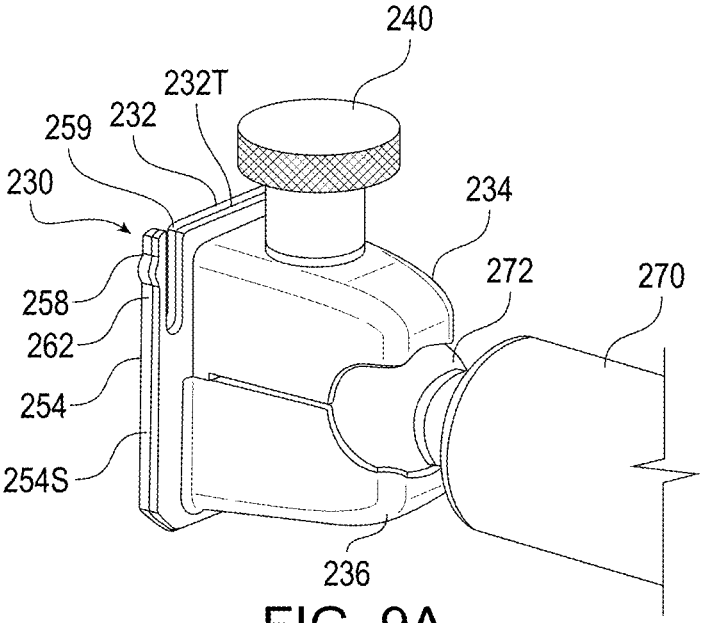
FIG. 9A is a perspective front view of another exemplary embodiment of the row bar pivot assembly.
Figure 9B:
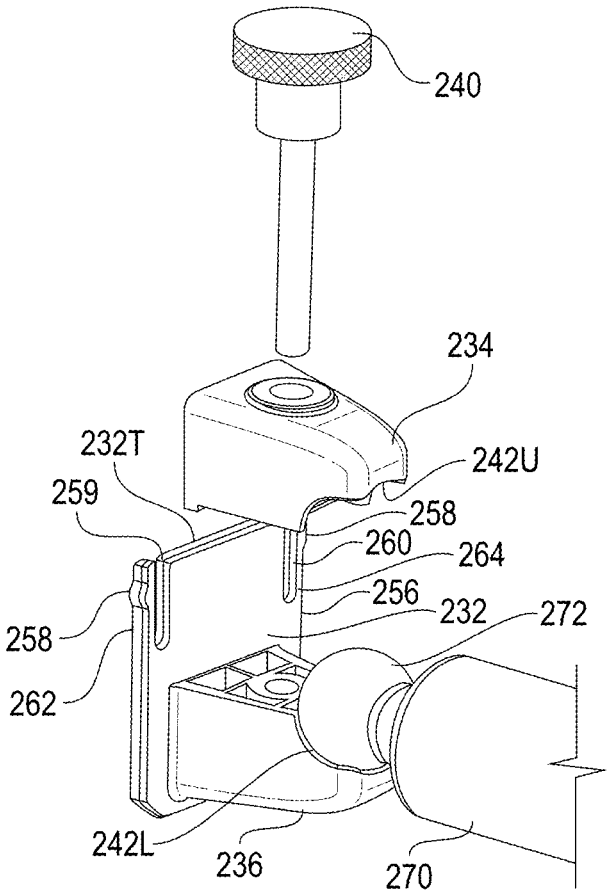
FIG. 9B is an exploded perspective front view of the row bar pivot assembly of FIG. 9B.

In other embodiments, the row bar pivot assembly can comprise a ball and socket structure configured to be detachably connected to the mounting plate, which allows the row bar to be freely rotated by the user when the user rows the row bar in a rowing motion. FIGS. 9A and 9B collectively illustrate another exemplary embodiment of the row bar pivot assembly denoted by reference numeral 230. The row bar pivot assembly 230 includes a base wall 232, an upper clamp member 234, and a lower clamp member 236. The lower clamp member 236 is unitarily formed with the base wall 232. The base wall 232 includes marginal side portions that extend slightly past the lower clamp member 236, thereby defining first and second tongue members 254, 256. First and grooves 259, 260 extend downwardly from a top edge 232T of the base wall 232 adjacent to the upper portion of each tongue member 254, 256, thus forming inwardly and resiliently bendable tabs 262, 264. A wedge shape detent member 258 extends outwardly from outer sides 262S, 264S of each tab 262, 264. The upper clamp member 234 is removably connected to the lower clamp member 236 with a thumb-screw 240. The upper and lower clamp members 234, 236 respectively define upper 242U and lower portions 242L of a socket that pivotally receives and connects a ball member 272 attached to a distal end 270D of a row bar 270. Once the ball member 272 of the row bar 270 is positioned in the lower socket portion 242L of the lower clamp member 236 and the upper clamp member 234 is installed on top of the lower clamp member 236 with the upper socket portion 242U positioned over the ball member 272, the thumb-screw 240 is used to secure the upper and lower clamp members 234, 236 together, thereby clamping the ball member 272 of the row bar 270 in the socket, thus, connecting the row bar 270 to the row bar pivot assembly 230.

It should be understood that the invention is not limited to the embodiments illustrated and described herein. Rather, the appended claims should be construed broadly to include other variants and embodiments of the invention, which may be made by those skilled in the art without departing from the scope and range of equivalents of the invention. It is indeed intended that the scope of the invention should be determined by proper interpretation and construction of the appended claims and their legal equivalents, as understood by those of skill in the art relying upon the disclosure in this specification and the attached drawings.

What is claimed is:

1. A row bar mounting assembly comprising:

a mounting plate for fixedly attaching to a side wall of a spa, swim spa, a hot tub, or a pool; and a row bar pivot assembly detachably connected to the mounting plate, the row bar pivot assembly for removably mounting a row bar to the side wall of the spa, swim spa, the hot tub, or the pool, wherein the mounting plate includes a channel and the row bar pivot assembly includes a tongue member for slidable receipt in the channel of the mounting plate, to detachably connect the row bar pivot assembly to the mounting plate.

2. The row bar mounting assembly of claim 1, wherein the row bar pivot assembly includes an inner pivot yoke, an outer pivot yoke, and a pivot link pivotally connecting the outer pivot yoke to the inner pivot yoke.

3. The row bar mounting assembly of claim 2, wherein the pivot link and inner pivot yoke are configured to allow side to side and/or up and down pivoting of the pivot link relative to the inner pivot yoke.

4. The row bar mounting assembly of claim 2, wherein the pivot link and the outer pivot yoke are configured to allow side to side and/or up and down pivoting of the outer pivot relative to the pivot link.

5. The row bar mounting assembly of claim 2, wherein the pivot link and inner pivot yoke are configured to allow side to side pivoting of the pivot link relative to the inner pivot yoke and wherein the pivot link and inner pivot yoke are configured to allow up and down pivoting of the pivot link relative to the inner pivot yoke.

6. The row bar mounting assembly of claim 2, wherein the pivot link and inner pivot yoke are configured to allow up and down pivoting of the pivot link relative to the inner pivot yoke and wherein the pivot link and inner pivot yoke are configured to allow side to side pivoting of the pivot link relative to the inner pivot yoke.

7. The row bar mounting assembly of claim 2, wherein the outer pivot yoke includes a coupling member for attaching the row bar to the row bar pivot assembly.

8. The row bar mounting assembly of claim 1, wherein the row bar pivot assembly is configured to allow the row bar, when attached thereto, to be freely rotated.

9. The row bar mounting assembly of claim 1, wherein an inner pivot yoke of the row bar pivot assembly includes the tongue member.

10. The row bar mounting assembly of claim 9, wherein the channel of the mounting plate includes a first detent member and the inner pivot yoke of the row bar pivot assembly includes a resiliently bendable tab with a second detent member, wherein during the connection of the row bar pivot assembly to the mounting plate, the tongue member slides into the channel until the second detent member engages the first detent member, thereby locking the row bar pivot assembly to the mounting plate and wherein during the detachment of the row bar pivot assembly from the mounting plate, the second detent member disengages from the first detent member when the tab is bent, thereby unlocking the row bar pivot assembly to the mounting plate and allowing the tongue member of the row bar pivot assembly to slide out of the channel of the mounting plate.

11. A rowing exercise system, comprising:

a receptacle for containing water, the receptacle sized to allow a user to stand, squat, and/or sit in the receptacle, the receptacle having opposing side wall areas;

a pair of row bar mounting assemblies, one for each of the opposing side wall areas, each of the row bar mounting assemblies comprising:

a mounting plate for fixedly attaching to the side wall area of the receptacle;

a row bar pivot assembly detachably connected to the mounting plate; and a row bar attached to the row bar pivot assembly;

wherein the row bar pivot assemblies removably mount the row bars to the side wall areas of the receptacle, wherein the mounting plate includes a channel and the row bar pivot assembly includes a tongue member for slidable receipt in the channel of the mounting plate, to detachably connect the row bar pivot assembly to the mounting plate.

12. The rowing exercise system of claim 11, wherein each of the row bar pivot assemblies includes an inner pivot yoke, an outer pivot yoke, and a pivot link pivotally connecting the outer pivot yoke to the inner pivot yoke.

13. The rowing exercise system of claim 12, wherein the pivot link and inner pivot yoke are configured to allow side to side and/or up and down pivoting of the pivot link relative to the inner pivot yoke.

14. The rowing exercise system of claim 12, wherein the pivot link and the outer pivot yoke are configured to allow side to side and/or up and down pivoting of the outer pivot relative to the pivot link.

15. The rowing exercise system of claim 12, wherein the pivot link and inner pivot yoke are configured to allow side to side pivoting of the pivot link relative to the inner pivot yoke and wherein the pivot link and inner pivot yoke are configured to allow up and down pivoting of the pivot link relative to the inner pivot yoke.

16. The rowing exercise system of claim 12, wherein the pivot link and inner pivot yoke are configured to allow up and down pivoting of the pivot link relative to the inner pivot yoke and wherein the pivot link and inner pivot yoke are configured to allow side to side pivoting of the pivot link relative to the inner pivot yoke.

17. The rowing exercise system of claim 12, wherein the outer pivot yoke includes a coupling member that attached the row bar to the row bar pivot assembly.

18. The rowing exercise system of claim 11, wherein each of the row bar pivot assemblies is configured to allow their respective row bar to be freely rotated.

19. The rowing exercise system of claim 11, wherein an inner pivot yoke of the row bar pivot assembly includes the tongue member.

20. The rowing exercise system of claim 19, wherein the channel of the mounting plate includes a first detent member and the inner pivot yoke of the row bar pivot assembly includes a resiliently bendable tab with a second detent member, wherein during the connection of the row bar pivot assembly to the mounting plate, the tongue member slides into the channel until the second detent member engages the first detent member, thereby locking the row bar pivot assembly to the mounting plate and wherein during the detachment of the row bar pivot assembly from the mounting plate, the second detent member disengages from the first detent member when the tab is bent, thereby unlocking the row bar pivot assembly to the mounting plate and allowing the tongue member of the row bar pivot assembly to slide out of the channel of the mounting plate.

21. The rowing exercise system of claim 11, wherein the receptacle comprises a spa, swim spa, a hot tub, or a pool.

22. A bar exercise device mounting assembly comprising:

a mounting plate for fixedly attaching to a side wall of a spa, swim spa, a hot tub, or a pool, the mounting plate including a channel; and a pivot assembly including a tongue member for slidable receipt in the channel of the mounting plate, to detachably connect a bar exercise device to the mounting plate thereby removably mounting the bar exercise device to the side wall of the spa, swim spa, the hot tub, or the pool.

* * * * *